United States Patent [19]

Ackley

[11] 4,019,476

[45] Apr. 26, 1977

[54] VAPORIZER APPARATUS

[76] Inventor: Donald M. Ackley, 1115 17th St., Hermosa Beach, Calif. 90254

[22] Filed: Mar. 31, 1975

[21] Appl. No.: 563,693

[52] U.S. Cl. ..... 123/119 DB; 123/141; 261/78 R; 261/47; 48/180 R

[51] Int. Cl.[2] ..... F02M 23/02

[58] Field of Search ..... 123/141, 119 DB; 48/180 R; 261/78 R, 47, 108, DIG. 1

[56] References Cited

UNITED STATES PATENTS

| | | | |
|---|---|---|---|
| 1,761,692 | 6/1930 | Stepp | 123/119 DB X |
| 2,100,466 | 11/1937 | Bashford et al. | 123/119 DB |
| 2,153,350 | 4/1939 | Stimac | 123/119 DB |
| 2,588,474 | 3/1952 | Bellios | 123/141 X |
| 2,661,269 | 12/1953 | Briggs | 123/141 X |
| 2,977,205 | 3/1961 | Austin | 123/141 X |

FOREIGN PATENTS OR APPLICATIONS

| | | | |
|---|---|---|---|
| 639,309 | 6/1928 | France | 123/141 |

*Primary Examiner*—C. J. Husar
*Assistant Examiner*—Ira S. Lazarus
*Attorney, Agent, or Firm*—William W. Haefliger

[57] ABSTRACT

Apparatus to enhance vaporization of liquid particles entrained in a gaseous carrier comprises:

a. means including a chamber defining at least two flow paths for said carrier and particles, the carrier and particles in each path defining a flow stream, b. said means including surfaces directing said streams alternately to merge with mutual impingement and to separate, at different locations therealong.

The apparatus has particular utility with a carburetor for an internal combustion engine.

13 Claims, 6 Drawing Figures

12
12
10
14
14
2
78
15a
16
11
15b
74
2
79
81

10
12
12
14
14
15
16a
32
32
15a
19a
100
20a
17
16
16
76
72
79
77
11
47
47
16b
15b
19b
18
13
20b
13

5
76
15a
20a
33
16
30a
81a
31a
32
81b
3
30b'
30b"
70
33
30b
24
21
36
32
31a
37
81b
81a
31b
16
81
72
53
52
16
52
53
79

5
91
91a
90
81a
81b
81
15a
72
36
21
30b
53
30a
31a
52
20a
17
31b
16a
16
76
74
55
52
38
32
33
24
70
34
30c
58
31c
35
37
4
54
56
57
40
39
4
63
62
59
42
63
44
77
61
60
46
28
71
73
43
64
65
47
18
65
16b
75
25
30d
41
45
30e
48
31e
31b
64
15b
100
51
ENGINE
50

VAPORIZER APPARATUS

BACKGROUND OF THE INVENTION

This invention relates generally to vaporizers, and more particularly concerns apparatus for enhancing the vaporization of liquid particles entrained in a gaseous carrier.

There is a need in many fields for economizing in the usage of liquids dispersed in gaseous carriers. Enhanced economy can be achieved if the extent of vaporization is increased, i.e., if the liquid particles dispersed in the carrier are sub-divided or vaporized to greater extent. This is particularly important in the field of carburetion, where the degree of combustion efficiency is a direct function of the extent of vaporization of fuel in the air carrier; however, to my knowledge, prior devices lacked the unusual combinations of structure, modes of operation and results now afforded by the present vaporizer apparatus. For example, present day carburetors do not sufficiently disperse or atomize the fuel particles in the carrier air stream, whereby fuel economy greatly suffers.

SUMMARY OF THE INVENTION

It is a major object of the invention to provide vaporization enhancing apparatus meeting the above needs, and overcoming the problems of prior devices, a particularly important application being in the field of fuel particle vaporization in an air stream.

Basically, the apparatus comprises:

a. means including a chamber defining at least two flow paths for the carrier and particles, the carrier and particle in each path defining a flow stream, b. said means including surfaces directing the streams alternately to merge with mutual impingement and to separate, at different locations therealong.

As will appear, the flow path defining means may advantageously include generally parallel plates between which and at the sides of which the flow paths merge and separate, the paths desirably extending in serpentine relation to provide very compact and efficient apparatus; further, baffles are provided proximate the plate sides to cause the separating and merging flow streams to individually divide and recombine, for enhancing vaporization efficiency as will appear. In this regard advantage is repeatedly taken of the induced impingement of the flow streams and components of same, and their expansion, to cause or enhance atomization or vaporization of the fuel particles.

The process may otherwise be described as follows: In essence a carbureting section is utilized as a first stage, coupled or followed by multiple stages which produce a series of actions including coalescense and then dissemination, alternately, by a redundancy of steps. It could be further explained that the heterogenous mixture which leaves the first stage is caused to go through a series of baffles or barries which by reason of the path it follows causes it to go through alternate areas of high and then low pressures due to the multiplicity of paths and directions, causing a complex diffusion until a homogenous state of gaseous fuel and air mix is achieved. However, due to the gasifying of the fuel, additional air is desirably diffused into the present homogenous mix and further dispersed at a rate proportional to need of the engine. Two series of multiple jets are utilized, each of which is controlled by a linkage to the butterfly valve and interconnected as by means such as gears. Each of these two stages of multiple air-injectors can be adjusted independently in both the low and high volume positions, which establishes proportional variations at all positions between the high and low volumn settings. The change does not have to be linear but will be determined by the requirements of the type of engine and its normal loads. In addition, an air passage conduit conducts air from the area immediately beneath the control butterfly valve, on the high side of the butterfly, to control mixture valves, as will be described.

These and other objects and advantages of the invention, as well as the details of an illustrative embodiment, will be more fully understood from the following description and drawings, in which:

DRAWING DESCRIPTION

DETAILED DESCRIPTION

While the description will proceed with reference to use of the invention to vaporize liquid fuel particles in an air carrier, it will be understood that the invention has other vaporizing uses, such as dehydration, use in distillation processes, etc.

Figure 1:
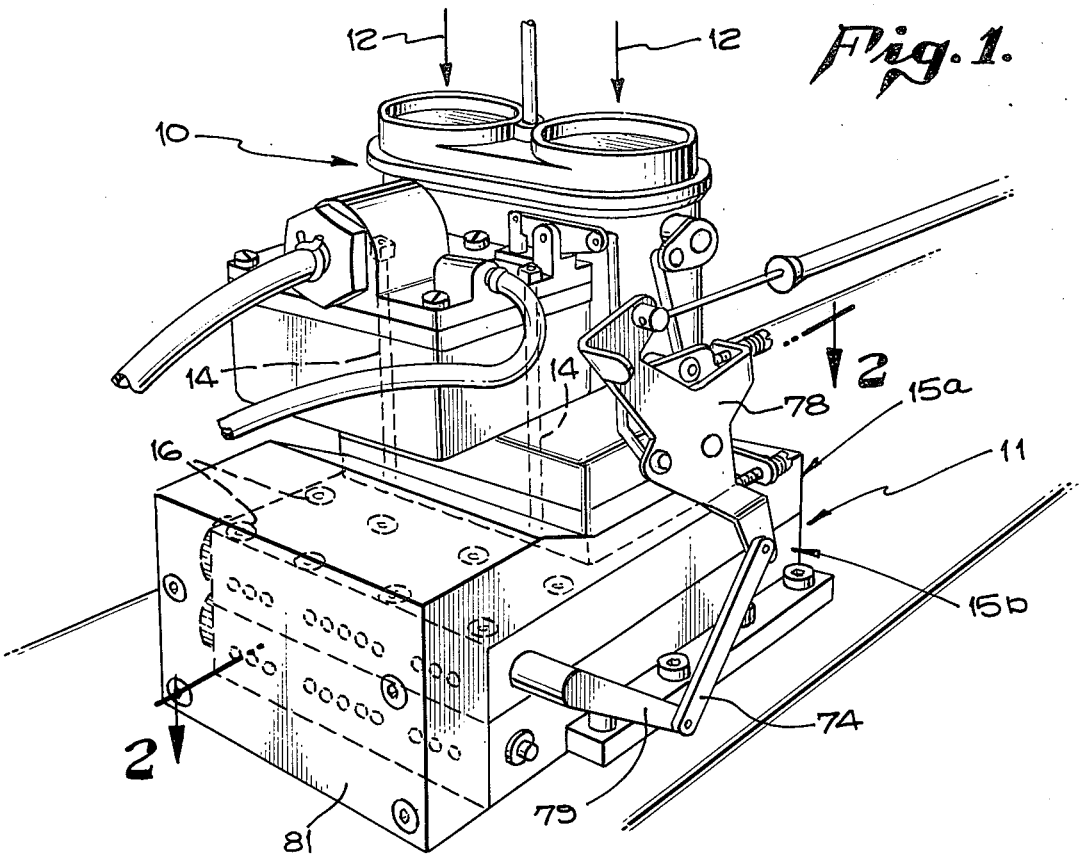
FIG. 1 is a perspective view of vaporizer apparatus incorporating the invention.
Figure 2:
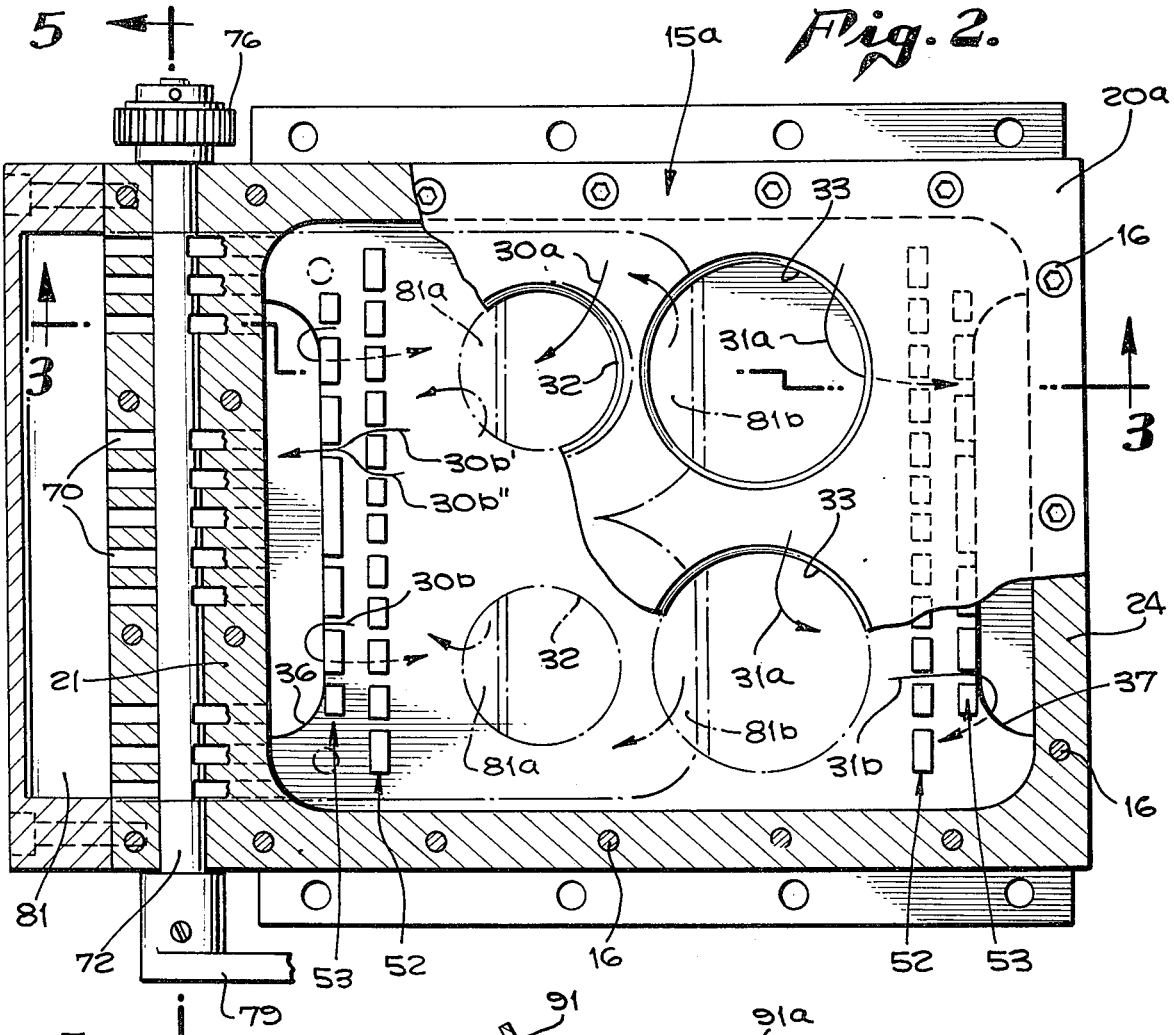
FIG. 2 is a plan view taken in section on lines 2—2 of FIG. 1.

In FIGS. 1 and 2, an air-fuel carburetor 10 is shown mounted on a vaporizer 11 incorporating the invention. Air enters the carburetor at 12, and air entraining "atomized" liquid fuel particles leaves the vaporizer at 13. Merely for purposes of illustration, fasteners 14 are shown to retain the carburetor on the vaporizer.

The vaporizer basically comprises means including a chamber 15 defining at least two flow paths for the carrier and liquid particles (in this case air and fuel particles entering the vaporizer from the carburetor), the carrier and particles in each path defining a flow stream; and such means includes surfaces directing the streams alternately to merge with mutual impingement (so as to optimize fuel particle break-up) and thereafter separate, at different locations along such flow paths. Chamber 15 may for example include upper and lower sections **15*a* and 15*b* joined together as by fasteners 16. the sections respectively define interior recesses or hollows 16*a* and 16*b*** within which the flow paths are defined and extend in serpentine relation.

More specifically, the flow path defining means may with unusual advantage include parallel upper and lower plates 17 and 18 with integral baffles thereon, the upper plate with the baffles being similar to the lower plate with its baffles, or the two may be alike. A divider plate 100 extends intermediate the upper and lower plates, and parallel thereto. All of such structure fits closely between the interior surfaces **19*a* and 19*b* of chamber upper and lower walls 20*a* and 20*b*, respectively. Also, the plate 17 extends transversely between the interior surfaces of the side walls 21–24 of the upper section 15*a*, and plate 18 extends transversely between the interior surfaces of the side walls 25–28 of the lower section 15*b***.

Figure 3:
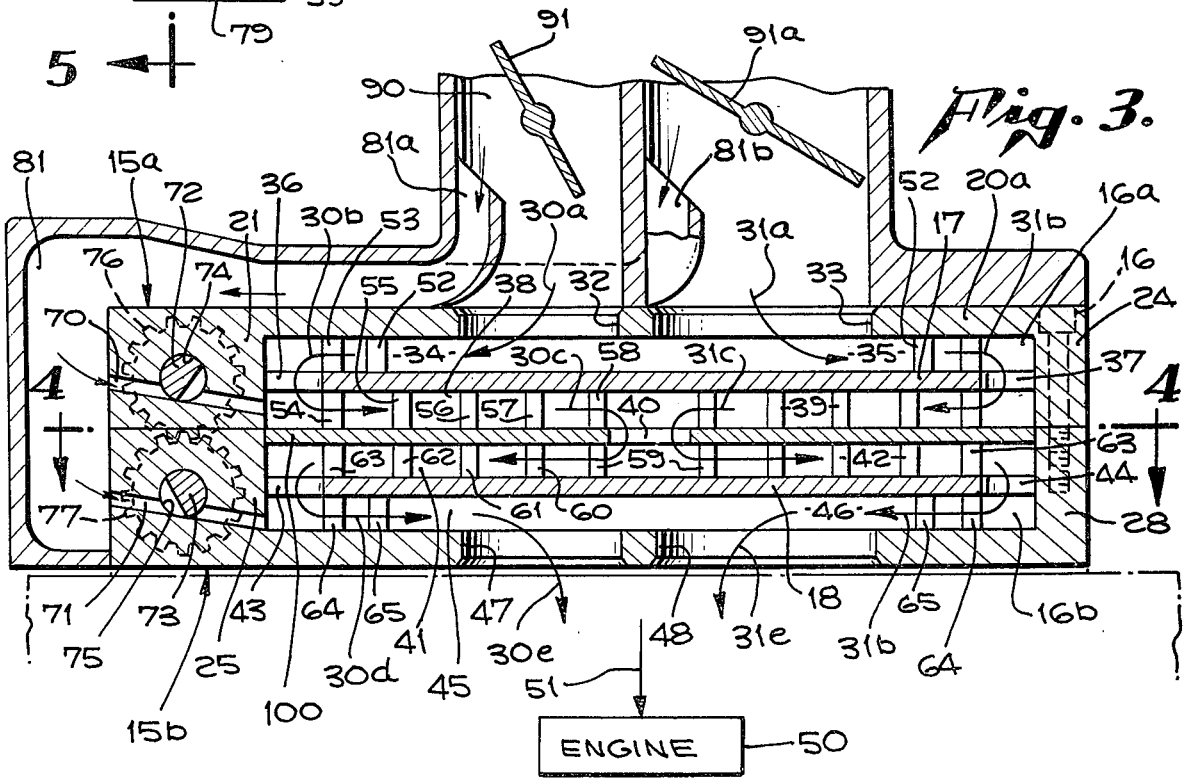
FIG. 3 is a vertical section on lines 2—2 of FIG. 2.
Figure 4:
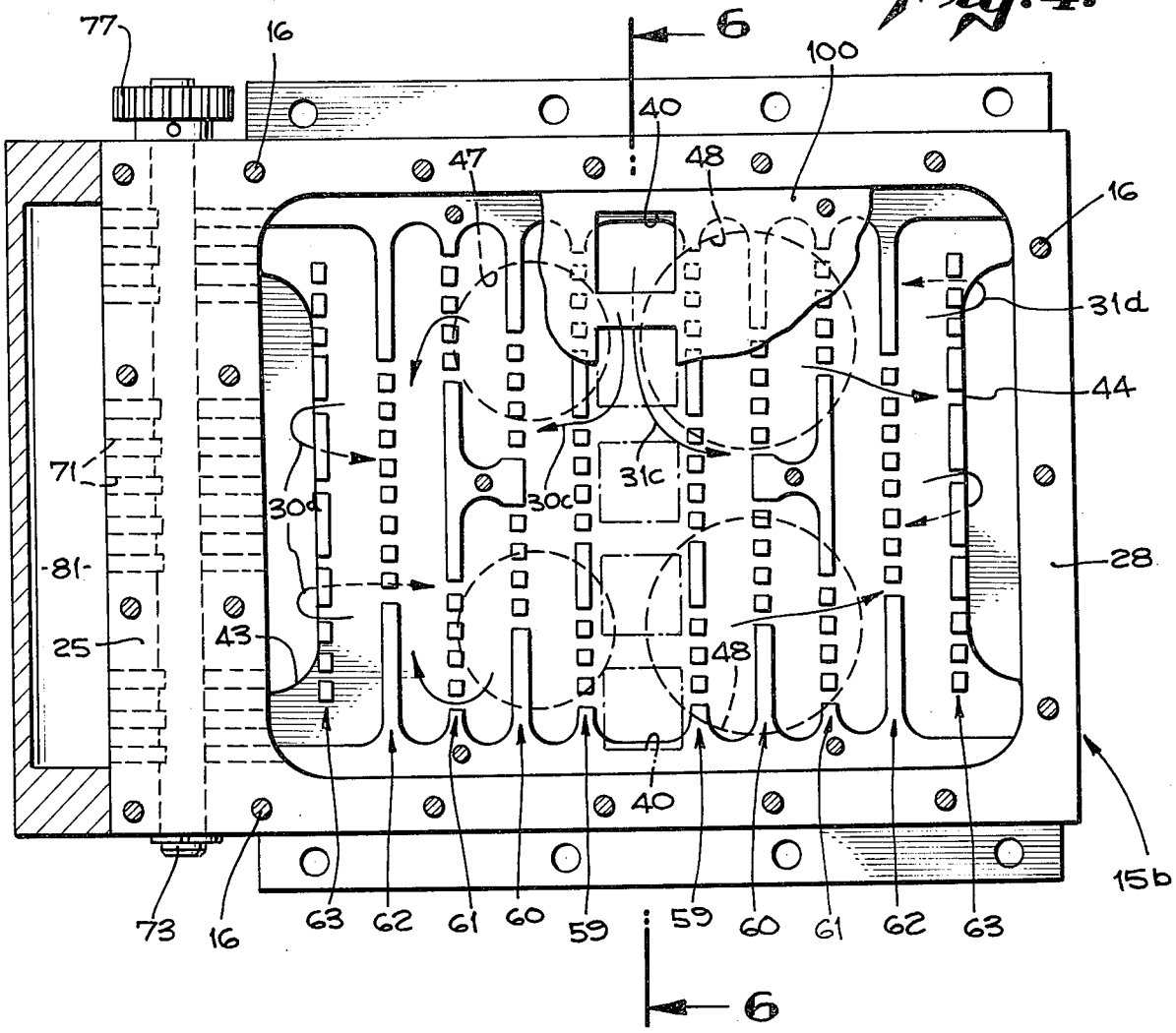
FIG. 4 is a plan view taken in section on lines 4—4 of FIG. 3.
Figure 5:
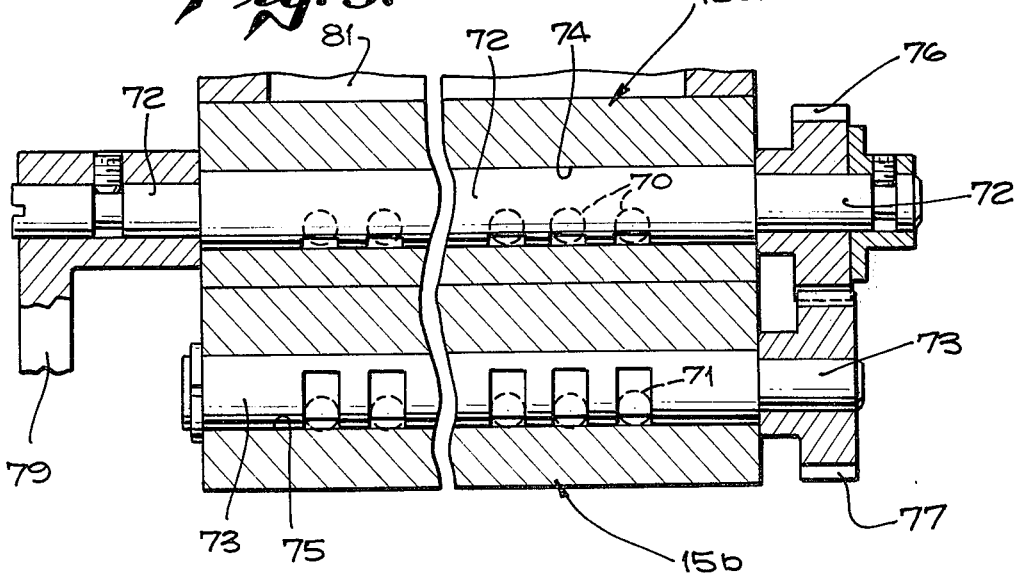
FIG. 5 is a vertical section on lines 5—5 of FIG. 2.

FIGS. 2–4 clearly show the definition, by the flow path defining means, of multiple flow paths, one of which is indicated by arrow sequence 30*a* – *30e*, and another of which is indicated by the arrow sequence 31*a* –*31e*. Thus, for example, the entering air and fuel particle streams enter the vaporizer from the carburetor as designated by arrows 30*a* and 31*a* passing downward through entrance ports 32 and 33 respectively in the upper section wall 20*a*. The flow streams then travel laterally oppositely in zones 34 and 35 above plate 17. The latter forms downward through openings 36 and 37 at its lateral extremities to pass the separated flow streams downwardly, as indicated by arrows 30*b* and 31*b*, enabling the streams to return laterally toward one another in zones 38 and 39 between plates 17 and 100.

After merging with impingement upon downward travel through central through openings 40 in divider plate 100, the two flow streams again separate as indicated by arrows 30*c* and 31*c*. The flow streams then travel laterally oppositely in zones 41 and 42 between plates 100 and 18. The latter forms downward through openings 43 and 44 at its lateral extremities to pass the separated flow streams downwardly as indicated by arrows 30*d* and 31*d*, facilitating return lateral flow toward one another in zones 45 and 46 between plate 18 and wall 20*b* of chamber lower section 15*b*. The streams then leave the vaporizer via exit openings 47 and 48, for flow via manifold passages to the engine 50, as indicated by arrow 51 in FIG. 3.

Figure 6:
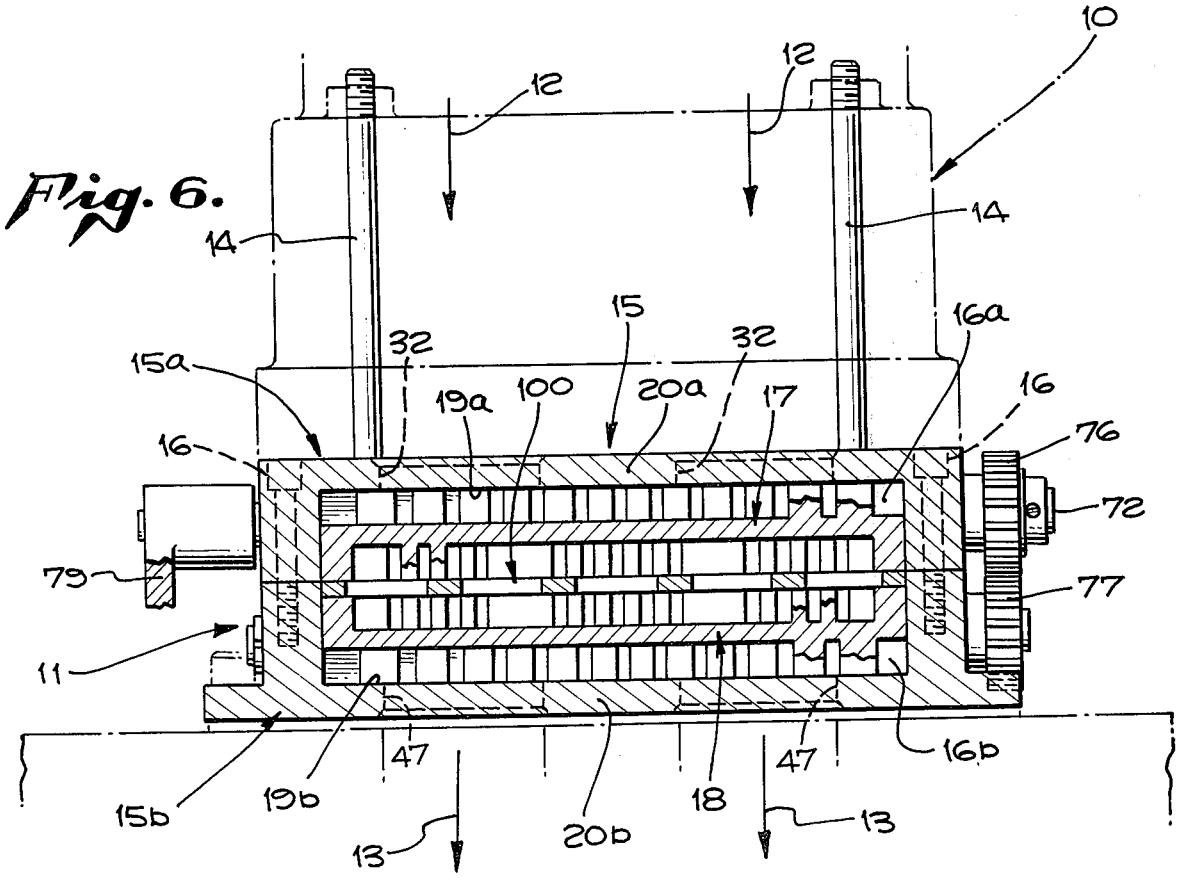
FIG. 6 is a vertical section on lines 6—6 of FIG. 4.

The flow path defining means may with unusual advantage include certain baffles proximate certain plate sides for causing separating flow streams to themselves divide and combine, enhancing vaporization. As an example of this, note spaced and staggered baffles in rows 52 and 53 in FIGS. 2 and 3 in the paths of separating flow streams 30*a* and 31*a*, each of which divides and combines as indicated by arrows 30*b'* and 30*b''*, for example. Similarly, the flow path defining means may with unusual advantages include other baffles proximate other plate sides causing the merging flow streams to themselves divide and recombine. For example, note the spaced and staggered baffles in rows 54–58 in FIGS. 3 and 4, in the paths of merging flow streams 30*b* and 31*b*, each of which divides and recombines while flowing past and between the baffles in such rows. All the baffles in rows 52–58 are integral with plate 17, as seen in FIG. 6.

Likewise, baffles in rows 59–63 divide and recombine the separating flow streams 30*c* and 31*c*, in zones 41 and 42 (such baffle rows corresponding to baffle rows 52–58 in inverse order), and baffles in rows 64 and 65 divide and recombine the merging flow streams 30*d* and 31*d* in zones 45 and 46 (such baffle rows corresponding to baffle rows 52 and 53, in inverse order). All the baffles in rows 59–65 are integral with plate 18 as seen in FIG. 6. Accordingly, the assembly is quite simple, as it includes only the two chamber sections 15*a* and 15*b*, the upper and lower plates 17 and 18 with associated integral baffles, and divider plate 100, thereby enabling rapid installation and servicing, all without disassembly of the carburetor structure per se. Also, the vaporizer may be employed with a wide range of carburetors, and only the sizes of the entrance and exit openings or ports 32, 33, 47 and 48 need be altered.

Another important aspect of the invention concerns the provision of valve controlled means for supplying additional carrier gas (as an example air) to at least one of the described flow paths within the vaporizer. Such means may include valve controlled side ports or jets 70 and 71 in sections 15*a* and 15*b*, ports 70 communicating with zone 38, and ports 71 with zone 45. Rotary valve spindles 72 and 73 in bores 74 and 75 in those sections control flow of air via the ports from the exterior to the listed zones to vary the fuel air ratio or mixture, as may be necessary or desirable. Gears 76 and 77 on the spindles are in mesh to simultaneously control the rotation of both valve spindles, admitting more air to each port, simultaneously, as the spindles turn. In this regard, the carburetor typically has a butterfly valve control mechanism including crank 78, and the latter may be coupled as at 79 with spindle 72, so that increased flow of auxiliary air to the vaporizer zones 38 and 45 occurs in response to increased opening of the butterfly valve; i.e., the mixture may be "leaned out", for greater fuel economy, as the efficiency of vaporization is enhanced due to higher flow rates of air and fuel particles through the vaporizer. The spindles can be adjustably rotated relative to each other, to increase or decrease the amount of air delivery via the ports, as required.

Air passage conduit 81 carries air from the area 90 immediately under the control butterfly valves 91 and 91*a* (on the high side of the butterfly) to the control mixture valves 72 and 73. This prevents upsetting or improper functioning of vacuum advance mechanism for the ignition spark. It also provides clean air, as the air taken from conduit inlets 81*a* and 81*b* has gone through the normal air cleaner. Also, the vacuum control for the spark advance is not disturbed. The conduit 81 and inlets 81*a* and 81*b* may take various forms, and the filtered air provided at inlets 81*a* and 81*b* may be provided by any suitable air cleaning means.

I claim:

1. In apparatus for enhancing vaporization of liquid particles entrained in a gaseous carrier, a. means including a chamber and plates defining at least two flow paths for said carrier and particles, the carrier and particles in each path defining a flow stream, said plates extending in generally parallel and spaced apart relation, the flow paths separating and merging at opposite sides, respectively, of each plate, b. said means including certain baffles proximate certain plate sides causing said separating flow streams to themselves divide and combine, and other baffles proximate other plate sides causing said merging flow streams to themselves divide and recombine, said baffles extending generally normal to the plates and being integral therewith to cause the flow to impinge on the baffles.

2. The apparatus of claim 1 wherein said paths extend in serpentine relation.

3. The apparatus of claim 1 wherein said plates include first, second and third plates, the flow streams separating at the upper side of the first plate, and passing it to a primary zone between the first and second plates via opposite end openings in the first plate, the flow streams merging in said primary zone and then passing through an intermediate opening in the second plate into a secondary zone between the second and third plates, the flow streams separating in said secondary zone and then passing to the lower side of the third plate via opposite end openings in the third plate, the flow streams then merging at said lower side of the third plate.

4. The apparatus of claim 3 wherein said apparatus includes upper and lower chamber sections enclosing said plates, there being two inlet openings in the upper section located to pass the carrier in two flow streams, one stream to the left and the other stream to the right at the upper side of the first plate, there being a carburetor having two barrels respectively in alignment with said two inlet openings and in direct communication therewith.

5. The apparatus of claim 3 wherein said two flow paths are generally symmetrical adjacent plate surfaces.

6. The apparatus of claim 3 including valve controlled means for supplying additional carrier to at least one of said flow path.

7. The apparatus of claim 1 including means supplying said flow to said apparatus and in the form of liquid fuel particles entrained in air carrier.

8. The apparatus of claim 7 including valve controlled means for supplying additional air to at least one of said flow paths downstream of a flow stream entrance defined by said chamber.

9. The apparatus of claim 3 wherein said chamber has at least one inlet for said flow stream, and including valve means for supplying additional gaseous carrier to at least one of said flow path downstream of said entrance and proximate an edge portion of at least one of said plates.

10. The apparatus of claim 1 wherein said apparatus comprises a dehydrator.

11. The apparatus of claim 1 wherein said apparatus comprises distillation structure.

12. The apparatus of claim 6 including a carburetor mounted on the vaporizer apparatus, the carburetor having butterfly valve controlling mechanism, said mechanism coupled with said means to control supply of additional air to at least one of said flow paths to increase said supply of additional air in response to increased opening of said butterfly valve.

13. The apparatus of claim 12 wherein said valve controlled means includes an air valve proximate a side of said chamber, and a conduit communicating directly between the downstream side of the carburetor butterfly valve and said air valve.

* * * * *